US005127674A

United States Patent [19]

Lamphere et al.

[11] Patent Number: 5,127,674

[45] Date of Patent: Jul. 7, 1992

[54] COUPON ORGANIZER INDEXED BY AISLE NUMBERS, HAVING STORE DIRECTORY AND ADVERTISING TO DIRECT SHOPPERS

[76] Inventors: William H. Lamphere, 254 Main St., Whitesboro, N.Y. 13492; Gary W. Lamphere; Judith W. Lamphere, both of 17 Greenleaf Dr., Exeter, N.H. 03833; Rick Lamphere, 8 Upper Pandora Ct., Telluride, Colo. 81435

[21] Appl. No.: 630,545

[22] Filed: Dec. 20, 1990

[51] Int. Cl.[5] ..... B42F 21/00

[52] U.S. Cl. ..... 283/37; 283/36; 283/67; 40/371

[58] Field of Search ..... 281/45; 283/36, 67, 283/37, 38, 41, 70; 40/371, 388, 390

[56] References Cited

U.S. PATENT DOCUMENTS

| | | | |
|---|---|---|---|
| 4,034,539 | 7/1977 | Economy | 281/45 X |
| 4,312,393 | 1/1982 | Green | 281/45 |
| 4,652,014 | 3/1987 | Maher | 283/36 |
| 4,795,196 | 1/1989 | Hyun et al. | 283/67 |

*Primary Examiner*—Timothy V. Eley
*Assistant Examiner*—Willmon Fridie, Jr.

[57] ABSTRACT

The invention discloses a portable clutch purse style coupon-holding device indexed to an actual store's aisles, and having a listing of items and their respective aisle locations in an on-board store directory. The user files coupons under the aisle division that corresponds to the product's aisle location, so that later, while shopping, when one finds the product on an aisle, one may retrieve that coupon under that aisle's related division within the device. The store directory has a transparent overlay on top of it whereupon one may compile a shopping list. While shopping, by referencing the location of the items marked on one's shopping list in the store directory visible below, the shopper may determine which aisles must be shopped and which may be skipped. The dividers may have advertisements for products sold on that division's related aisle; and such advertisements serve the dual-purpose of giving the user graphic cues showing whether the device's rotating leaves are turned to the appropriate aisle division. A special receptacle is tethered by a connector to the coupon-holding device so that it may easily be used for storagte of coupons for products selected, while shopping, until the shopper reaches the cashier.

7 Claims, 9 Drawing Sheets

COUPON ORGANIZER INDEXED BY AISLE NUMBERS, HAVING STORE DIRECTORY AND ADVERTISING TO DIRECT SHOPPERS

BACKGROUND OF THE INVENTION

1. Field of the Invention

This invention relates to tab-indexed printed material, and more particularly, to a method for and a special receptacle device which implements the organizing of merchandizing coupons by means of logical filing of them for easy and effective retrieval later, while shopping. This invention uses an indexing method whereby each filing division relates to one aisle or other sales area of an actual store; and the device includes an on-board store directory for use in pre-sorting coupons by the location of their product within that store. Additionally, the device may include: locationally-related dual-purpose point-of-purchase advertising on the dividers, divider components ring bound so as to manually-rotate, or a separate special receptacle tethered to the coupon-holding device for temporary retension of coupons for products selected until such time as they are tendered for credit at the cashier's counter.

With prior art that sort by category of product, the categories are broad and encompass several types of items. Therefore, while in the store, the user has to "fine-sort" through a general category to find those coupons for the specific type of item that one contemplates purchasing.

When using the devices that have previously been patented, the shopper goes through the following three determinations each time one wants to see if there is a coupon for a product: he must find the product within the store; he must determine under which general filing category such an item may have been pre-filed; and he must discover whether or not that filing division is the correct one in which to be looking for its coupon. To make matters worse, our shopper must do this for each product in which he has an interest.

The present invention allows the user to avoid repetious in-store sorting through a number of divisions on each aisle. Since it is indexed by aisle, all coupons retrieved from an aisle-related grouping of coupons are relevant to purchases that may be made right there on that related aisle.

No longer must the shopper search through each of a number of filing divisions for coupons that are relevant to products being considered on just one aisle. With the present invention, all coupons within an aisle's division are relevant thereon.

The following steps apply to retrieval of coupons from the present device: a shopper has previously compiled a shopping list on the overlay and, while shopping, reviews the names of those items and their aisle locations to determine which aisles to shop; on one of those aisles, the shopper finds a grouping of shelved products within the category of one of the listed items; and retrieves the coupons previously filed under that aisle's division and reviews them for coupons applicable to that item.

This device is meant to advance the public benefits of simpler filing and less confusing and faster in-store retrieving. The manner in which it goes about these objectives is to organize coupons in a manner that minimizes the numbers of determinations that a shopper needs to engage in during one visit to the store, and to make those that remain simpler, so that the shopper has more mental energy to devote to more constructive things while there, such as comparison shopping, and still gets through with coupon shopping faster than would otherwise be the case.

The device implementing the present invention combines this filing by aisle feature with a store directory feature so that the user may refer to the store directory in order to determine the product's aisle location and deduce the correct aisle division into which to file away newly-acquired coupons. The device therefore helps accomplish the two things that are imparatives when coupon shopping: finding the item and finding any coupon for it.

This presentation by aisles also serves to assist the shopper in using more coupons, because review through the grouping may well suggest the additional purchase of one or more other items from that aisle, even though the items were not on the shoppers list. This tends to benefit shoppers, since a coupon clipped and unused is a wasted opportunity to save, and since greater use of coupons tends generally to reduce ones annular total expenditures for those items.

During the better part of the last two decades, merchandising coupons have been issued by product manufacturers to encourage shoppers to but their product as a result of a credit allowance on its purchase price. During that time, real family purchasing power has declined, so shoppers have endeavored to make increasing use of coupons to defray costs. Throughout this period, shoppers have attempted to organize their coupons in a manner that would allow them to re-cast the filing and retrieval cycle in such a manner as would be simple, yet could be joined to other shopping operations in a manner that would make the entire process easier by being less confusing and frustrating.

Many shopper report having become discouraged with coupon shopping; and this stems from using ineffective filing methods, such as indexing coupons according to product category. The inefficiency of this method stymies the user's individual resolve, because one has to endure tedious in-store sorting of coupons within those product categories in order to obtain relevant coupons.

By making coupon shopping more scientific and logical, it is anticipated that it will become less confusing and frustrating, and that this will tend to induce the users of this novel device to stick to couponing more tenaciously, thereby achieving more admirable long-term savings.

Various patents have been issued for coupon organizers. However, their filing methods have undertaken to sort only according to "what" general item category the coupon had been issued for, by "what" specific product the coupon is for, or by "when" it will expire. Until the instant invention, no organizer has undertaken to sort by "where" the user will be when he or she will next need to have that coupon in hand.

The present device's locational filing method and its locational shopping list overlay on its store directory enable the user to quickly and easily bring together, while shopping, all three key ingredients for successful coupon shopping with a minimum of effort, the decision-maker, the product, and the coupon for that product.

During the last two decades, coupon issuance through newpapers, magazines, direct mail, and in-product enclosure has soared. But this volume of issuance has outpaced the coupon shoppers' abilities to absorb and use the additionally issued coupons effectively. This is due to their filing methods' not being capable of supplying additional helpful information about where an item is in a particular store and where its coupon would be stored within their coupon-holding device.

For example, by 1989, some 276 billion manufacturers' grocery coupons were distributed annually, each having an average value of approximately 46c. Nationwide in the United States, approximately 40% of the supermarkets have extended the inducement and offer double coupon redemption credit, up to some fixed maximum amount per coupon. If all of the coupons that were distributed in 1989 had been redeemed, even for single-value credit, their total value would have been approximately $126 billion; and that amount is roughly half of all that was spent on all grocery items purchased at supermarkets throughout the country.

However, only $3.12 billion in total credit was obtained by shoppers. This means that only about two and one-half percent of all coupons distributed were redeemed. That translates into one coupon in forty being utilized. Because of such a low rate of redemption, coupons saved shoppers only about one and one-fourth percent, on average, on all of their supermarket purchases. These data make clear the untapped potential savings yet to be achieved if a device were to exist which would somehow make in-store finding of relevant coupons significantly easier.

The novel organizing method utilized by this invention makes every coupon retrieved under that aisle's division relevant to a purchase that may occur right there while shopping on that aisle. Furthermore, because of the locational nature of the present invention's filing method, it aptly receives the addition of other location oriented features which allow it to go beyond merely being a method for finding one's coupons efficiently, extending out to include listing items to be obtained, and finding them in the store efficiently. It is this total effectiveness that so enhances the shopper's use of time and mental energy that it appears to users to have tipped the scales in the direction of making shopping with coupons worth the effort for those who engage in this invention's location oriented systems.

The device, using this invention's filing method, fulfills shopping objectives in a variety of manners. First, such a filing method can best function with the inclusion of an on-board store directory within the device. Using the directory, one may find items in the store without asking; and determine where to file away newly-acquired coupons. The combination of the filing by aisle and store directory features enables one to relate what is known or can be determined in such a manner as to solve for what is unknown. Examples of this are the solving for the location of the coupon when one has located its product, or solving for the location of a product when one has located its coupon. Second, with a store directory exhibiting item names and their respective aisle location, the placement of an overlay above it allows the user to compile a shopping list on that overlay, and, while shopping, to refer to the following: the name of the item and any additional specifications, such as any particular brand name, product feature, flavor, quantity, size, color, etc., as a reminder; and to the respective aisle location of each as a means of shopping only the aisles that need to be shopped in order to obtain all of the items that are on the shopping list. In this manner, the shopper avoids being unnecessarily tempted to engage in impulse buying, and significantly speeds up and simplifes the shopping process. After, shopping, the notations made on the overlay may be erased by means of the user cleaning it with a dampened piece of paper toweling.

2. Description of Relevant Art

U.S. Pat. No. 4,260,055 to Slaybaugh has product categories placed on its indexed divider tabs, and suggested that these divisions might either be arranged alphabetically or in an order known to the user in which the items involved would be encountered while shopping. The present invention goes a couple of steps farther. Its tab indicia more perfectly mirror the store's layout than some general arrangement of broad product categories, not all of which are necessarily clustered together anyway. The present invention accomplishes this by means of aisle indicators that use the same letters or numbers as the actual aisles and these are interspersed with the letter abbreviations for special non-aisle sales areas where appropriate. A second distinction is that the present invention includes an on-board store directory, which enables the user to definitively determine where to file a coupon away; and definitively determine from which division to retrieve it. This is not always the case when using a device like that shown in the Slaybaugh patent, which has divisions labelled "canned vegetables", "fruit", and "sauce". A user might find it difficult to determine where to file or retrieve a coupon for a can of stewed tomatoes, the kind used to make homemade spaghetti sauce, for example. Tomatoes technically are fruit, the item is canned, although not a vegetable, and the item is used in conjunction with the making of a sauce. Such a quandry is totally avoided with the present device because the stewed tomatoes are shelved on a certain aisle or sales area, and there is no room for duplicity.

The prior art, including the Slaybaugh patent, and U.S. Pat. Nos. 4,450,994 to Holland and 4,795,196 to Hyun, which use a filing method indexed according to general product categories, necessitate that while in the store the user must do a significant amount of this fine-sorting. For example, among the filing division labelled "beverages", one may have to fine-sort for coffee coupons on one aisle; and then may have to again sort through that "beverages" division during the same shopping trip on other aisles to look for coupons for other beverage-related items, such as apple juice, soft drink, etc. This means that many of the various filing divisions may have to be gone through repeatedly during the same trip. The store shopping cart is not the place to attempt to accomplish this fine-sorting, given its shortage of flat work space and the instability that comes with the movements of the cart.

Other prior art, such as U.S. Pat. Nos. 4,591,054 to Blossom and 4,802,575 to Martin, have a two-tiered approach to their filing divisions, whereby each of the principal categories are broken into sub-category filing divisions. Although, these devices offer more divisions, and thereby reduce some of the in-store fine-sorting, it is not significantly reduced since each of these devices sorts only by product categories.

U.S. Pat. No. 4,034,539 to Economy discloses a store directory. Its device is not even a coupon organizer, but instead is a writing desk that attaches to the topmost horizontal member of the back rack of the front hopper of a shopping cart and pivots so as not to interfere with the carts' nesting within one another while not in use.

Users may clip the shopping list that they have brought into the store onto this desk, then compare the items on their shopping list with a store directory that is made a part of this shopping cart attachment. Consequently, the device is of no assistance to the user outside of the store, either in determining the aisle division into which to file a coupon, or in serving as a reminder by listing the items from which one may choose, which are but two of the benefits of using the present invention.

Furthermore, the instant device's use of an on-board portable store directory also makes it possible to place a transparent overlay over that store directory. Since that transparent overlay is superimposed above the list of the store's items and their aisle locations, the overlay allows the user to look through it and to compile thereon an erasable shopping list, right within the device. One compiles the shopping list by means of perceiving the names of items thereunder, which are the names of the items at that store from which one may select, by observing the image of the name right through the transparent overlay. Next, one may circle, underline or otherwise indicate that the item is needed and may add some particulars regarding it. Then while shopping, the shopper reviews the names of items marked on the shopping list, notes their aisle locations, and organizes one's shopping around the aisles which must be shopped in order to obtain all of the items that are on the list.

Therefore, while using the present device, one does not have to compare two separate lists while in the store, as is the case with the device patented by Economy, because with the present device one's shopping list and the store directory are one visual entity rather than two separate fields. Also, the inclusion of a shopping list into the coupon-holding device tends to ensure that neither one's list nor one's coupons are forgotten and that both get brought to the store, even on small shopping trips; and this results in more consistent coupon use and greater overall savings.

Beyond the Economy patent's writing desk attachment, U.S. Pat. No. 5,002,215 to Gregoire, the Holland patent, and U.S. Pat. Nos. 4,442,940 to McIntosh and 4,966,318 to Dutka all utilize the principal horizontal members of the shopping cart to support their coupon-holding devices. The Gregoire patent is a file box on a plate that straddles the main horizontal members of the top of an opened front hopper and is held from sliding forward and back by downward extensions beneath the plate. The Holland patent is a file box that clips onto the handle of the shopping cart. The McIntosh patent is a file box with cam-shaped hooks that engage the upper horizontal member of the frontmost rack of the front hopper of the shopping cart from which the device hangs. The Dutka patent is an accordian-sided coupon container with two vertically-mounted flexible attachment tabs that eminate from the back of the container near its top and wrap around a horizontal member of the shopping cart and seal to the back of the container to allow the device to be hung from that horizontal member. None of the prior art utilizes a separate retension strap; and none has a retension mechanism designed to mount horizontally to stabilize the device against one or more of the vertical members of the frontmost rack of the shopping cart to retain the device in position as it rests upon the floor portion of the front hopper of the shopping cart, as set forth by the instant invention.

U.S. Pat. Nos. 4,892,192 to Hague and 4,463,848 to Parker use alternatives to the filing of coupons according to general product categories. The Hague patent sorts coupons alphabetically by product name. The Parker patent indexes coupons by the month of their expiration date; and the Martin patent also includes an expiration date filing method as an alternative along with filing by general product categories.

U.S. Pat. No. 4,742,911 to Manuel discloses a device for grouping items on one's shopping list under broad product categories by means of names of items being printed on strips that the user clips into position under that broad category so that the shopper obtains each item in that category's department before leaving it and does not have to return to it.

The Slaybaugh patent included a pocket within the device's cover into which the shopper could place coupons for products that had been selected from the shelves that were in the process of being purchased.

Several of the devices of the prior art made allowances for the shopper to be able to bring related articles associated with couponing along into the store while shopping, paricularly sissors. None, until now, however, has been designed to bring in a store directory, or to include an on-board component whereupon the user may compile a shopping list; and none has a separate special receptacle tethered to the principal device within which to temporarily file coupons for products selected until reaching the cashier.

The general shape of coupon-holding devices has evoluted from that of a bi-fold coupon album as seen in U.S. Pat. Nos. 3,911,605 to Morhack, 4,004,690 to Giarrittia, and 4,312,393 to Green, on to a rigid file box as seen in the patents to McIntosh, Holland, Parker, Hyun, Martin, Hague, and Gregoire, on to a semi-rigid box with accordian sidewalls as seen in the Dutka device, and finally culminating in the compact, adequate and attractive forms as seen in the flexible clutch purses of Slaybaugh, Blossom and the present invention. As to the latter format, the present invention is the only one with a mechanism for retaining it while it is in use.

The Hyun patent included advertising on its dividers. However, these dividers were indexed by generic product categories; and each advertisement modifies and further describes the generic product within whose category it falls. Nothing, however, with regard to the advertisement in the Hyun patent helps the shopper to locate that advertised product within the store because they are category-related; the present invention's ads, by contrast, relate to aisle numbers and thus are locationally-related. Therefore, they inform the shopper about where to locate the advertised product in that store.

The aforementioned examples of prior art universally arranged their filing division components in a card-file modality, except for the Martin patent with multi-pocketed pages mounted into a multiple ring binding. But the Martin patent does not claim to be designed to have leaves that are mounted so as to render the device flat-opening, as is the case with the instant invention.

The depth dimension of the pockets within which the coupons are filed in prior art are uniformly scant, thus making it difficult to finger through the coupons in the process of reviewing them. The present invention manually-rotates to fully open so that the user has unfettered access to that compartment's envelope; and thus, unrestrained access to the coupons therein. This makes it much easier to sort through and review them.

The Hyun invention's device has no top; but does have several external advertisements placed on its sides.

The filing method Hyun uses is that of filing by generic product category. Therefore, that device may be used just as well in any store as in the store whose name is set forth in those advertisements. However, the present device's tabs are locationally-indexed to a common pattern of shopper traffic through a particular store. Since the present device functionally relates to only that one store, its solo advertisement on its cover, which is positioned on the cover's top, serves to inform the user of the device as to the name of the store to which that device is indexed. This may be of importance to the shopper who has more than one of these devices, each indexed to a different store, for it allows the shopper to tell the devices apart without opening them up to look inside.

SUMMARY OF THE INVENTION

The present invention is a bound booklet of filing division components placed within a checkbook-like cover to form a clutch purse type coupon-holding device. The divisions are indexed to the aisles of an actual store; and arranged in a pattern that follows a pattern of shopper traffic flow throughout the aisles and other non-aisle sales areas of that store. One means of fabrication is for generic units to be made with separately printed tab labels that adhere to the blank dividers' tabs by means of an adhesive backing when placed in an order that mirrors the numbers of the aisles of a store shopped by the consumer-purchaser. However, the preferred embodiment envisions custom fabrication to a particular store's layout for that store or its chain which, in turn, sells or otherwise makes the device available to its customers as a promotional item.

The device has card dividers between which are located transparent plastic envelopes for holding that aisle division's coupons. Each divider card has an aisle indicator on its tab which displays the number, letter or abbreviated name of the aisle to which its filing division relates.

These alternating card and envelope components are punched and multiple ring bound into a booklet of leaf components. These leaves may be manually-rotated by the user so that the device is flat-opening, for example, on a table while filing away coupons, and as flat as conditions permit while resting in the front hopper of a shopping cart, during shopping, to provide a relatively solid and stable surface upon which to engage in handling of coupons, and to provide maximum access to the coupons stored within that division.

The present device is designed to be opened, if at all, only to one aisle division at a time. This keeps all of the other compartments, not then being refered to, closed. However, the one to which the user chooses to have the device opened is totally opened. The flat-opening feature ensures maximum access to the coupon-retaining transparent envelope, either while filing, or retrieving the coupons previously filed, under that aisle division.

The present invention's method of filing by aisle may be utilized in a vertically-standing card file modality. However, the preferred embodiment utilizes rotating filing divisions, having division components that are punched and bound into a manually-rotatable booklet of leaf components with each aisle-related filing division having its own transparent plastic retension envelope for coupons. In that manner, the aisle-related compartments are kept closed until the user selects one aisle division at a time to which to have the device opened. Even though that one aisle division is opened as fully as supporting conditions permit, its coupon contents still do not slide around or out of its dividers because they are held securely within the walls of the envelope by means of electrostatic force until those coupons are removed by the user.

This rotational operation of the device further provides the opportunity to place display advertisements on the divider cards that relate to the aisle where the products being advertised are located. This provides what is known as point-of-purchase advertising impact because, as the shopper turns the leaves of the device to the aisle division corresponding to the aisle then being shopped so that all coupons relevant to purchases on that aisle are at hand, the advertisements are rotated into the shopper's view and serve as reminders while he or she is shopping on the very aisle where the advertised product is offered for sale.

Likewise, there is placed on the tabs of the dividers the general names of items that are available on that division's aisle. In that manner, both the advertisements on the divider surfaces, and the item names on its tab tend to further define and explain that aisle and its aisle indicator by means of causing the user of the device to associate the general items, the specific advertised products, and the number with that aisle of that store.

The rotational embodiment of the device may additionally include a separate special receptacle for use as a place within which to temporarily store coupons for products selected until such time as the shopper reaches the cashier's counter. Such a receptacle may take the form of a pocket-type retension envelope. In a vertically-standing card file modality it may be positioned among the dividers. In a rotational modality, it may be positioned among the bound leaves. But the preferred embodiment of this pocket for coupons in process is to tether it to the device. Recognizing that efficiency demands minimal turning of the leaves of a rotational device while shopping, the preferred means is to fasten it to a connector that is attached to the coupon-holding device. The tether is to be of sufficient length to allow the special receptacle to either be placed among the leaves of the coupon-holding device when it is not so being used, in the nature of a bookmark, or alternatively placed outside of and nearby the device, while shopping. This placement is an advancement over mounting it among the leaves because to do so would necessitate the following for the shopper: to turn from the aisle division to which the device was opened to the special pocket, store the coupon, determine to which division the device had been opened, and turn back to it. Instead, the externally-positioned tethered pocket is readily available for use, without any turning.

Advertising that causes the one who receives its intellectual impressions to relate the advertised product's location in a particular store with the location of the advertisement within the coupon-holding device performs a dual-purpose. Such directional advertising may be placed upon a device using a vertically-positioned card file modality. In such a case, the advertisements would be flipped to as the user moved the tabs of the various aisle's dividers from one to the next while shopping from one aisle to the next. In that manner, these advertisements exhibited on the non-tab surfaces of the dividers would pose what is known in the advertising trade as "point-of-purchase" advertising impact because their advertised product was available right there on that aisle. Even though the preferred embodiment of the present invention uses rotational filing compartments instead of vertically planar ones, the same principles nonetheless apply because they, too, are designed to come up into view exactly on the aisle where that product is sold.

The advertising space available upon the dividers of the device may be sold to the store or its chain for whom the device is being custom printed, in order for it to advertise its modestly-priced store brand products to cost-conscious shoppers right at the point-of-purchase. However, the preferred embodiment envisions placing advertising for nationally-advertised brands upon those divider surfaces.

In addition to the remainder advertising value of the divider exhibits, the general nature of the intellectual images that subliminally operate upon the user serve the dual-purpose, in addition to the advertising message, of providing graphic cues that help the user keep the leaves of the device turned to the correct division for filing and for retrieving coupons. The advertisements' graphics are larger and easier to perceive than the wording and numbers on the tabs. Over time, the user will gravitate away from having to read the tab indicia, and will begin to be able to simply rely upon the graphics of the advertisements as cues as to whether the device is opened to the correct aisle's division, both while filing coupons away at home, and while shopping among the aisles of that store. From a quick glance at those advertisements on the dividers it becomes clear to the user, for instance, that aisle 3 is devoted to soft drinks and that aisle 12 has the paper items.

Previous coupon-holding devices had covers. But they did not provide for enwrapping a booklet type of device whose leaves rotate on a binding.

The covers of prior art devices offered no means for securing their devices positionally while resting on the floor of the front hopper of a moving shopping cart. The present device's cover is three-fold in design and, except for its third panel which is a flap, is similar to a checkbook cover that is held onto its booklet by means of one or more slip pockets into which the outermost leaf of the booklet may slide.

The cover has two sets of cooperating hook and loop fasteners that secure its first and flap panels together when sealed. But when the device is being used, while shopping, it is opened and placed in the front hopper of a shopping cart, its associated retension strap may be positioned around the frontmost vertical wall of that cart such that the similar fasteners near the ends of the retension strap contact and seal to the aforementioned fasteners on the exterior surface of the first panel of the cover. In that manner, the strap will restrain the covered device from moving within the cart, despite the cart's motion.

Prior art does provide the means for bringing articles into the store along with the device which are associated with shopping. The present invention includes a sealable pocket within the device's cover which may be used as a purse to retain such articles as car keys, credit or other identification cards, pocket calculator, currency, or a check. This may be of particular importance to the female shopper whose clothing has no pockets and who desires not to have to bring her pocketbook into the store.

If she does bring her pocketbook into the store, some minimal degree of security for an unattended pocketbook and coupon-holding device is provided by the instant invention's retension strap being threaded through the frontmost wall of the cart as described, by means of running the retension strap through the pocketbook strap as well. With that done the shopper is assured that the distinctive sound that is made when such a fastener is uncoupled will occur if an unauthorized taking of either takes place even while her back is turned.

The locational orientation of the instant invention also allows the issuing store to utilize it to achieve additional store loyalty among its customers. The issuing store is assured that its recipient-shoppers, those to whom these devices are distributed, will tend to return over and over to shop at the store, if for no other reason than that they have filed away their coupons within the device and have become committed to thinking around coupon shopping with it at that location. Once one gets accustomed to consistently high percentages of savings, it is difficult to forego those savings achieved at the issuing store, especially if it means that shopping elsewhere means that the device is not going to be nearly as helpful there, thus tipping the balance in the direction of it not being worth the effort at the other location. To avoid the tedium that would accompany all the extrapolation from the present device's being indexed to one store but being used in another, the shopper is highly likely to find that it is far simpler and less frustrating just to continue to use the device and stay loyal to the store to which the device is indexed, rather than to shop there on one occasion and somewhere else on the next. This objective of store loyalty may be directed toward regular patrons and toward new customers, reaching out for those who are attempting to simplify the coupon shopping confusion and are willing to trade the universal but ineffective prior art devices for a novel form tailored to a store they shop or are willing to patronize in order to achieve consistently high savings with considerably less effort than they expended before.

This store directory feature is transformed into a locational shopping list by means of a transparent overlay above the printing of the store directory cards. One may compile their shopping list on the overlay by means of circling, or underlining the printed name of an item listed in the directory and showing through the overlay. An erasable writing instrument may be used for this purpose and, after the shopping trip, the notations may be erased by means of a dampened piece of paper toweling.

While shopping, one may review the names of items and other notations made on the overlay, and may read through the overlay the aisle location within that store of each item on the shopping list, which aisle information had been placed on the store directory below the overlay. In that manner, the shopper may determine exactly which aisles need to be shopped in order to obtain all of the items on the list, and infer which may be skipped.

Names of items sold on an aisle are included on the tab along with the aisle indicator. Advertising may be placed on the faces of the dividers that relate to the aisle where the advertised product is displayed for sale. Both the item names on the tabs and the advertisements on the divider surfaces serve to modify and describe the aisle indicator by encouraging the user to associate its number or letter with those items or brand-name advertised products.

In addition to advertising value, these advertisements provide intellectual impressions to the user which serve as graphic cues as to whether or not the user has the manually-rotated leaves of the printed device turned to the appropriate aisle division while filing coupons or retrieving them.

A separate but associated special receptacle is tethered to the coupon-holding device by means of a connector. The tether allows the user to place it either within the coupon-holding device, in the manner of a bookmark when not in use, or outside the device while shopping so that coupons for products one has selected on that aisle may easily be stored therein to segregate them until they are retrieved for presentment to the cashier.

The present device's locational sorting method and its locational shopping list overlaying its store directory enable the user to quickly and easily bring together, while shopping, the decision-maker, the product, and any coupon for that product.

Prior art failed to effectively provide a relatively flat and stable area whereupon to sort. This is important, especially given the rolling nature of one's shopping cart. The present coupon-holding device, by opening fully so that the device lies as flat as possible, may be placed open to the division relating to the aisle being shopped and laid flat upon the floor of the front hopper of a shopping cart. This device will still retain its coupons securely, despite the motion of the cart, because each aisle's coupons are securely held inside that aisle division's transparent envelope by electrostatic force, until the shopper removes them.

The effect of less sorting is that the user of the present device is less harried and confused by the process of coupon shopping, and is thus better able to concentrate upon the real money-saving aspect of comparison shopping, where the shopper factors net pricing, after any coupon discounts, of the various competing products into their relative quality differences to determine which product is the best value.

Each divider card has an aisle indicator placed upon its tab. This indicator may be one or more numerals, or letters that are the same as those used to designate the aisle to which that division relates, or may be a series of letters abbreviating the name of an undesignated sales area within that store which may be identified by its position or by the nature of the items displayed for sale thereon. The following is a list of such sales areas whose identifying terms may be used within the device and abbreviated on the tabs of its dividers:

1. Back of Store
2. Bakery
3. Beer
4. Customer Service
5. Dairy Case

-continued

6. Delicatessen
7. Fish
8. Floral
9. Front of Store
10. Frozen Foods
11. Greeting Cards
12. Meat
13. Natural Foods
14. Pharmacy
15. Produce
16. Special Pricing
17. Special Services
18. Video Rentals This method for storing and retrieving coupons works logically because each coupon has been pre-filed into a filing division which is indexed to an aisle where that coupon's product is located within a given store. Therefore, that coupon may easily be accessed thereunder for use later while shopping on the aisle of the store while that category of item is being considered for possible purchase.

The filing method which is a part of this invention creates a logical chain. The major elements involved with coupon shopping, each of which is sought to be understood or obtained by the user of the coupon-holding device, are portrayed in the following by capital letters, the logical nexus of the elements' inter-relationships are portrayed in lower-case letters, and certain special features of the present device are portrayed to the right side in underlined letters:

```
THE COUPON FOR THE PRODUCT
    on its face is printed
        THE PRODUCT'S NAME
    the product is within
            the group of
        THE ITEM'S NAME *       gets marked in the        SHOPPING LIST
                                *
    which is shelved on                 *                 overlays the
                                            *
THE AISLE LOCATION OF THAT                          *        STORE
    ITEM WITHIN THAT STORE      *     *     *     *      * DIRECTORY
has related identity with
        THE AISLE DIVISION
        WITHIN THE DEVICE
            which contains
THE COUPON FOR THE PRODUCT
```

The asterisks portray the fact that the store directory displays names of items in that store together with the aisle location of each of those items. It should also be noted that the first and last link in the logical chain listed above, the 'coupon for the product', is the same element. This is because, although these elements are portrayed linearly, they, in fact, create a logical loop, like beads in a neckless, which is of a circular nature. This is important because it allows these logical steps to be run in either direction by the user of the device.

The user may begin with either knowledge of, or possession of, one of the major elements above. If the user has neither with regard to the elements, he or she may get started by referring to the store directory, which will provide a list of items and their location.

By employing this process, the user may solve for another element which then was unknown to him, or may determine where to go to bring an object that heretofore has been unpossessed into possession.

For example, by applying this process, the user who has a newly-acquired coupon may determine into which filing division of the device to file it. To do this, he would begin with possession of 'the coupon for the product' and he would be desireous of solving for the appropriate 'aisle division within the device'. He would start by observing 'the coupon for the product'. On its face is printed 'the produce's name'. Next, he would determine 'the item's name' by thinking about the relationship between 'the product's name' and 'the item's name'. That is, he would identify what item group that product was within. Next, he would relate 'the item's name' with 'the aisle location of that item within that store'. To accomplish this, he may have to refer to the store directory. Finally, he would note the related identity between 'the aisle location of that item within that store' and 'the aisle division within the device' and would file 'the coupon for the product' into that related aisle division. In this manner, the user files all of his coupons away.

During the days preceeding a shopping visit to the store, the user may enter the names of items desired in the 'shopping list' provided within his coupon-holding device.

Once the user is within the store conducting his coupon shopping, he has his coupon-holding device which contains his compiled shopping list therein. His coupons are filed away. The items that he wants are on the shelves of their respective aisles. He desires to have within his grasp, each of the items on his list and whatever coupons there are, within his device, which apply to those products he selects within the listed item groups.

To accomplish this, the shopper begins by referring to his 'shopping list'. There, for example, he sees that he had previously marked "catsup" as an 'item's name' which he desired to obtain at the store. He also sees through the overlay to the 'store directory' which shows 'the aisle location of that item within the store' as being "aisle 4". Finally, since he realizes the relational identity between 'aisle location' 4 and 'aisle division' 4, he walks to aisle 4 and locates the "catsup" on that aisle, and turns the leaves of his coupon-holding device to aisle division 4 and reviews the coupons thereunder for any that relate to the item "catsup". Using this method, the shopper brings into his possession each item on his shopping list from the aisles of the store, plus any coupons that were pre-filed into his coupon-holding device that are applicable to the products he selects within those item groups, and presents them all to the cashier, who credits him with the value of the coupons, keeps the coupons, and gives him the products selected, for which he has paid the difference.

Even though the preferred embodiment herein has undertaken to explain this invention solely in grocery store terminology, it should be clear from the forgoing that this invention is equally applicable with regard to any form of store which accepts merchandizing coupons tendered by shoppers in connection with their purchases.

This description has outlined the more important features of the invention so that the following detailed description may be better understood and appreciated. Accordingly, before explaining one preferred embodiment of the invention in detail, it is to be understood that the invention is not limited in its application to the details of construction and to the arrangements of the components set forth in the following descriptions of illustrated in the drawings. The invention is capable of other embodiments and of being practiced and carried out in various manners. Therefore, it is to be understood that the phraseology and terminology employed herein are for purposes of description only and should not be regarded as in any manner limiting this invention. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent construction insofar as they do not depart from the spirit and scope of the present invention.

The objectives herein set forth, taken together with other objects of the invention, along with the various features of novelty which characterize the invention, are pointd out with particularity in its claims, which are attached to and form a part of this disclosure. For a better understanding of the invention, its operating advantages and the specific objects attained by its uses, reference should be made to the accompanying drawings and descriptive matter in which there are illustrated preferred embodiments of the invention.

DETAILED DESCRIPTION OF THE INVENTION

Figure 1:
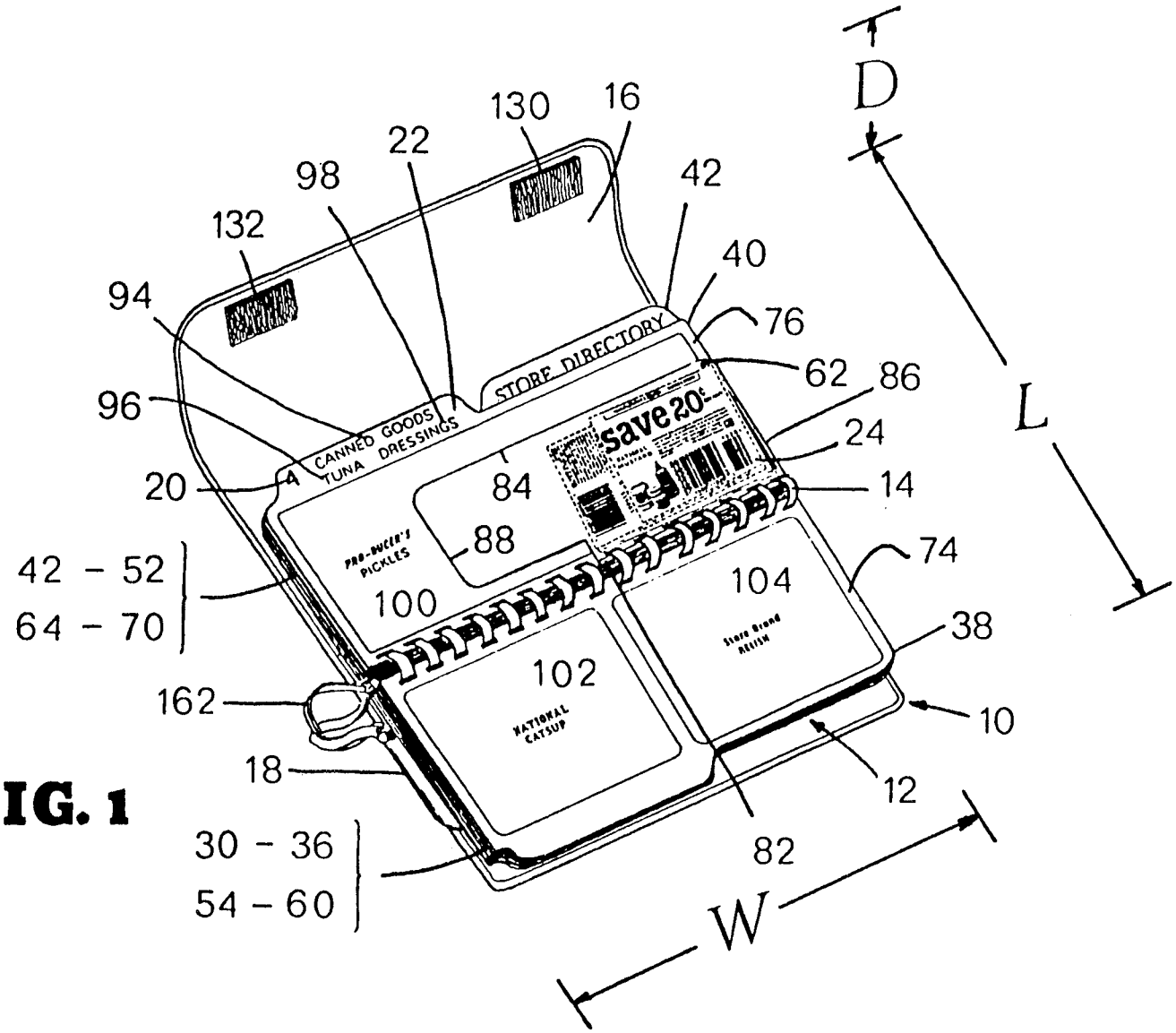
FIG. 1 is a perspective view of the coupon organizer device shown opened to a representative filing division exhibiting on its tab the aisle indicator and the names of items displayed on that aisle as well as display advertisements for brand name products that also are displayed for sale on the related aisle shown on the card divider surfaces of that aisle division.

FIG. 1 through FIG. 9 of the exemplary drawings are an illustrative embodiment of the best mode contemplated for carrying out this invention. Device 10 is generally comprised of booklet 12 having leaves comprised of the said alternating card dividers and envelopes, each of which are hinge-mounted and aperture affixed in planar fashion to binding 14. Booklet 12 has cover 16 that releasably seals to enclose it and any coupons contained therein; and device 10 has special envelope 18 tethered to it.

The said leaves of booklet 12 are generally comprised of the following:

a plurality of card dividers, 30 to 52, and a plurality of envelopes, 54 to 70, which are mounted to binding 14 and pivot rotationally around its latitudinal axis to open as fully as 180 degrees, and lie in a flat plane generally conforming to whatever horizontal surface is supporting it, to afford maximum user access to its coupon contents, and to stay opened so as not to require the user's holding onto device 10 while manually turning the said card divider and envelope leaves, or while storing coupons into or retrieving them from its envelopes.

The filing divisions of booklet 12 are indicated by means of indicia printed upon the tabs of its card dividers 30 to 52. These tabs are indexed to correspond to the numbered aisles and the named sales areas of a particular store. Each division has one of its own transparent pocket envelopes, into which the user stores and from which the user retrieves coupons that pertain to products displayed for sale on that aisle or in that sales area. Each envelope and its two adjoining card divider surfaces form a set, called a filing division. These sets are placed in an orderly arrangement, front to back in booklet 12, that corresponds to a typical path a shopper might take through the aisles and sales areas of that store's layout.

Figure 5:
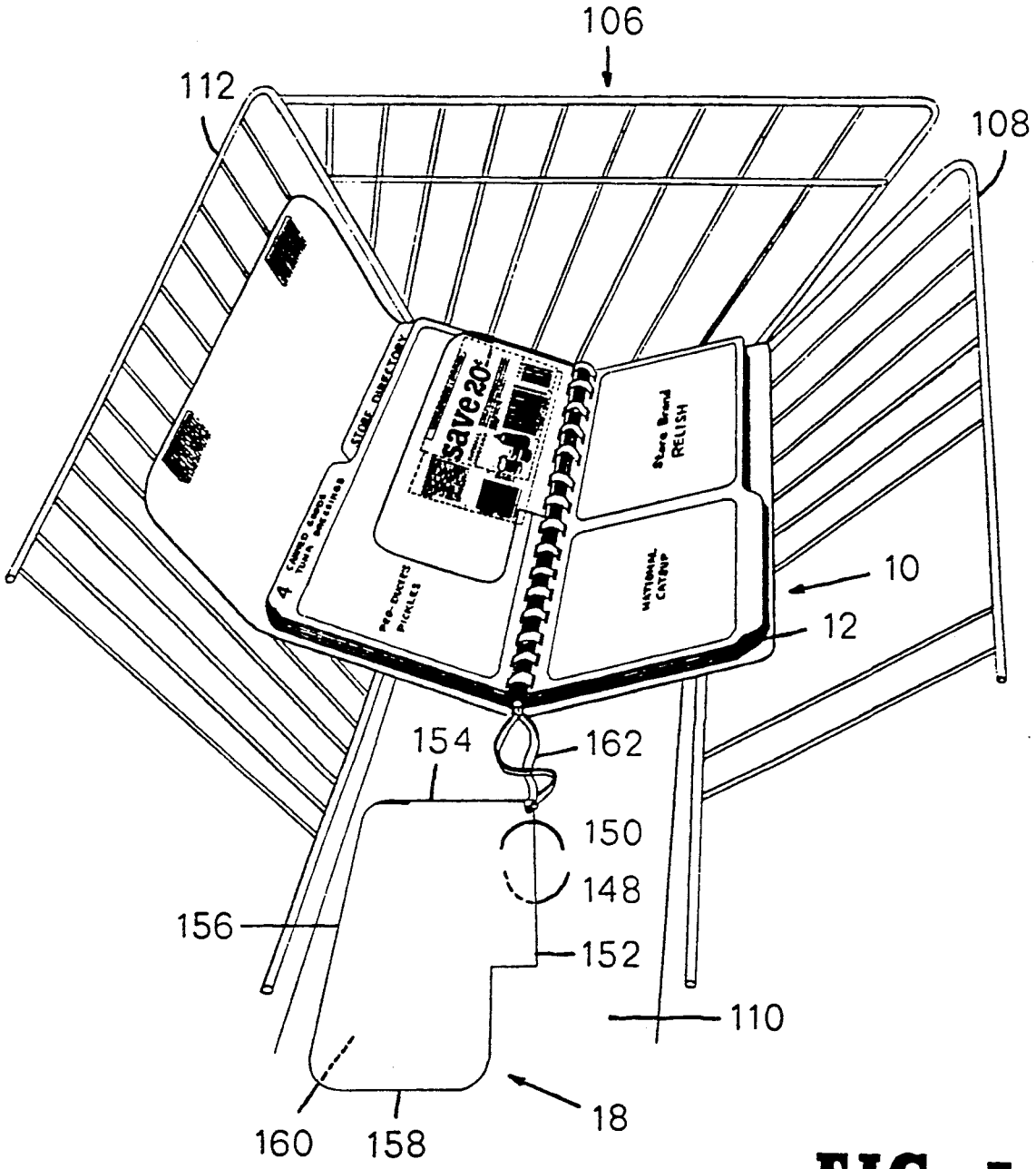
FIG. 5 is a perspective view showing the opened device being used in the folded open front hopper of a shopping cart with its tethered receptacle placed outside of the principal device where it may be used to temporarily hold coupons for items in the process of being purchased.

The filing method used by device 10 has two distinct steps to its use. The first is to completely sort newly-acquired coupons away under the correct filing division for each coupon. FIG. 1 depicts a representative filing division of device 10. The second step, while the user is in the store, is to retrieve those previously sorted coupons from the pertinent filing division of device 10, while device 10 is positioned in the front hopper of a shopping cart, as depicted in FIG. 5.

Referring to FIG. 1, to retrieve pertinent coupons, the user, for example, observes the number of the filing division, such as its aisle number or sale area name, 20, which is positioned in tab area 22, and turns the card divider tabs to the filing division whose number or name 20 corresponds to the aisle or sales area of that store within which the user then is shopping. Then the user either fingers through pre-sorted coupon grouping 24 contained within envelope 62 to review them, or retrieves the entire group of coupons 24 from pocket area 26 of that filing division's envelope 62 and holds and reviews them. Each coupon of a group of one or more coupons in coupon group 24 is relevant to purchases on that aisle or in that sales area where the user is shopping because each coupon was user-determined, when filed, to pertain to a product that is displayed for sale on that aisle or in that area of that store corresponding to the aisle number or sales area name 20 in tab area 22 on the card of that filing division.

The quantity of these said card divider and pocket envelope sets, called filing divisions, arranged in a typical shopper path sequence in booklet 12, varies according to the total number of that particular store's numbered aisles and unnumbered sales areas.

Figure 2:
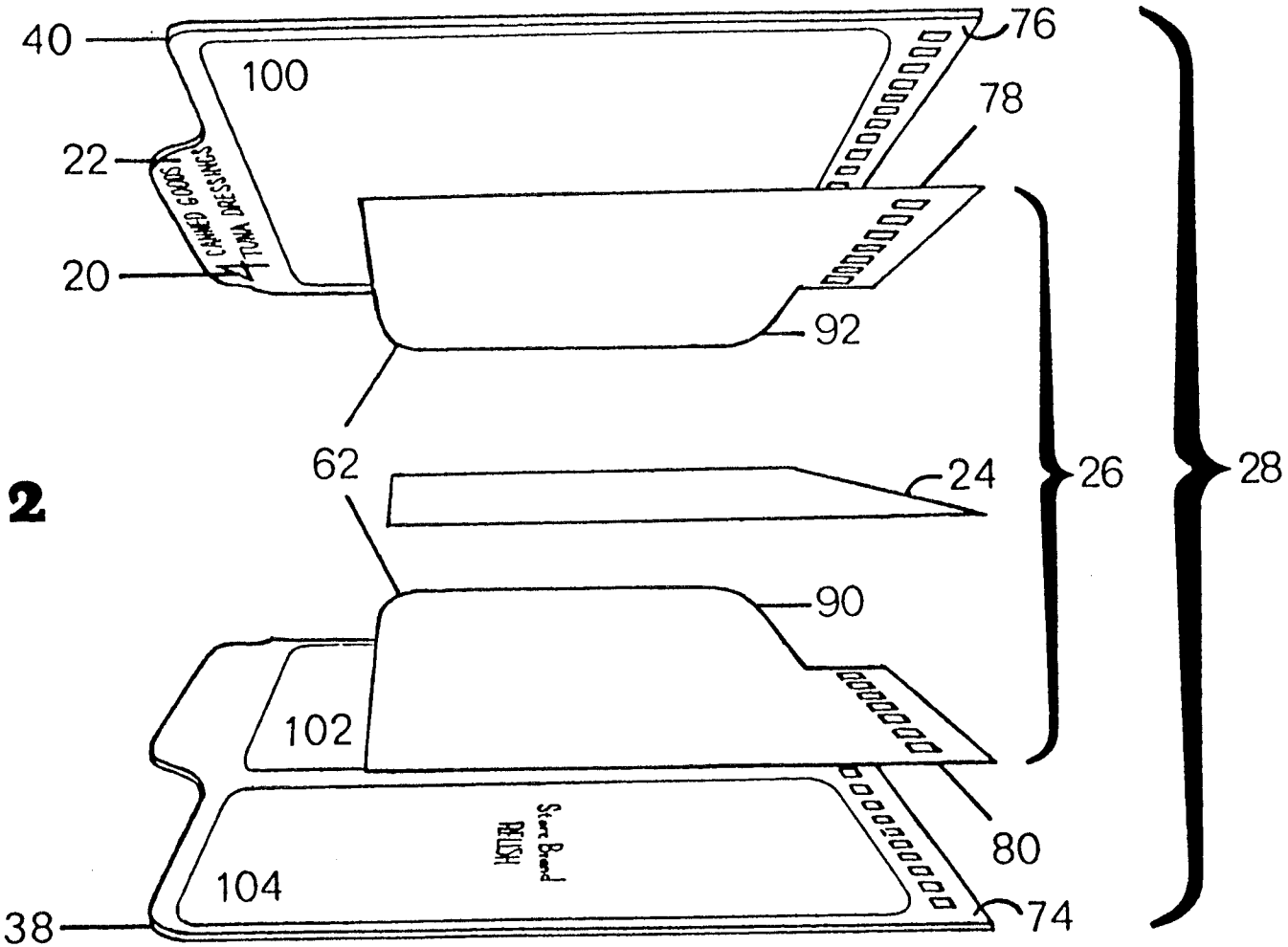
FIG. 2 is an exploded view perspective of the surfaces of components of the filing division shown in FIG. 1, which, when closed, form a closed compartment that retains its coupon contents.
Figure 4:
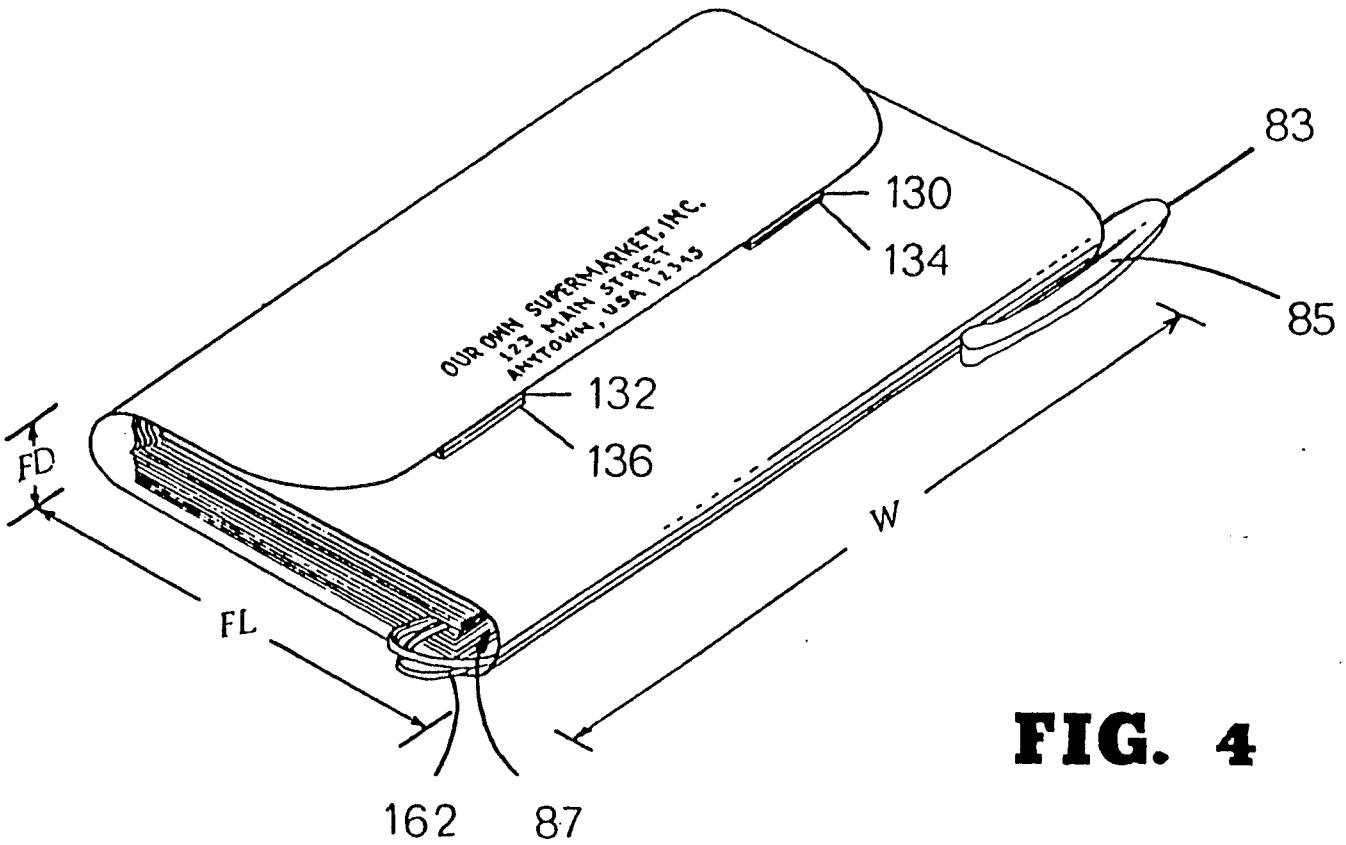
FIG. 4 is a perspective view of the device's cover showing its folded depth and folded length when closed, and having its erasable writing instrument and its tethered receptacle in their stored positions, and with an informative display advertisement on the top exterior surface of that cover for the store to which the device is indexed.

As depicted in both FIG. 1 and FIG. 2, envelope 62 and its adjoining card divider surface 74 on card 38 and its other adjoining card surface 76 on card 40 constitute one typical and representative filing division set within booklet 12 of device 10. When the entire device 10 is closed, as shown in FIG. 4, this closure transforms what was the representative opened filing division shown in FIG. 1 into the filing division compartment 28, which is shown in FIG. 2.

As depicted in FIG. 2, compartment 28 may have more than one place for filing coupons. For example, the user may place all manufacturers' coupons within pocket area 26 of envelope 62; and, also, separately place store coupons under that filing division having the aisle number or sales area name 20), but outside of envelope 62, that is, between either wall 78 of envelope 62 and the front surface 76 of card 40 or between wall 80 of envelope 62 and the back surface 74 of card 38. The divider cards 38 and 40 are transformed from being generally horizontal flat plane boundaries delimiting their filing division, which has the tab number or name 20, into the delimiting boundaries of compartment 28 for the coupon contents of that filing division as shown in FIG. 2 when device 10 is closed. The compartmentalization that occurs when device 10 is fully closed, as shown in FIG. 4, also occurs in all of those filing divisions depicted in FIG. 1 other than the one filing division to which device 10 is fully opened.

As displayed in FIG. 1, cards 38 and 40 of device 10 are so printed and so engaged into binding 14 that their positioning enables them to be readable from the user's point of view. To accomplish this, when this representative filing division is displayed to the user, the latitudinal axis of binding 14 runs generally horizontally across the user's field of view; and the lines of printing on card 38 and on card 40, as shown in FIG. 1, both run parallel to that latitudinal axis of binding 14 with the characters of the printing on each card generally pointing vertically upward and generally vertically downward from the user's point of view in a perpendicular direction from the latitudinal axis of binding 14.

This is also the case for the printing in the store directory section. As depicted in FIG. 1, the preferred embodiment places the store directory section at the midpoint of booklet 12 for the user's ease in apprehending this section's location within device 10. This is accomplished in the preferred embodiment by means of indicia on the tab of card 42 being positioned to stand at the forefront of the tabs in the last half of booklet 12, by means of these tabs being arranged on one side of booklet 12 in its front half and on the other side in its back half.

The following schematic is a graphic portrayal of the sequencing of the entirety of the card divider and pocket envelope leaves of booklet 12, back to front. The schematic shows the arrangement of booklet 12, the sequencing of its card dividers interspersed alternately each with one pocket envelope, and states the name of each component, which implies that component's function within the device, as depicted more generally in FIG. 1:

| | |
|---|---|
| a back slip strap card 52. | |
| a back of store area card 50. | |
| | envelope 70, between cards 48 and 50, for filing division called "Back of Store". |
| a seventh numbered aisle card 48. | |
| | envelope 68, between cards 46 and 48, for filing division numbered "7", |
| a sixth numbered aisle card 46. | |
| | envelope 66, between cards 44 and 46, for filing division numbered "6", |
| a fifth numbered aisle card 44. | |
| | envelope 64, between cards 42 and 44, for filing division numbered "5", |
| a store directory section card 42, having tab area 70 and no envelope. | |
| a fourth numbered aisle card 40. | |
| | envelope 62, between cards 38 and 40, for filing division numbered "4", |
| a third numbered aisle card 38. | |
| | envelope 60, between cards 36 and 38, for filing division numbered "3", |
| a second numbered aisle card 36. | |
| | envelope 58, between cards 34 and 36, for filing division numbered "2", |
| a first numbered aisle card 34. | |
| | envelope 56, between cards 32 and 34, for filing division numbered "1", |
| a produce area card 32. | |
| | envelope 54, between cards 30 and 32, for filing division termed "Produce", |
| a front slip pocket card 30. | |

The user manually stores and retrieves coupons by means of slipping each of these coupons into and out from within pocket area 26 of envelope 62, as depicted by the exploded view shown in FIG. 2.

As depicted in FIG. 1, when device 10 is opened to one of its several filing divisions, for example to the filing division having the aisle number or sales area 20, the user has exhibited within his or her field of vision the elements of only one such filing division at a time, since the elements of that one filing division in view are visually superimposed over all other closed filing divisions that numerically precede it, i.e., cards 30 to 36 and envelopes 54 to 60, and all those which numerically follow that filing division, i.e., cards 42 to 52 and envelopes 64 to 70; see FIG. 1.

Each of the said filing division compartments of closed booklet 12 is comprised of elements, back to front, that are shown in FIG. 2. Each of those elements relates to the numbered aisle or unnumbered sales area of that store having the same number or name, 20, as that which is printed on tab area 22. In each filing division the sequence of components is similar to those set forth in the following:

a. the tabbed card divider 40 having:
   1. tab area 22 exhibiting the number 20, which serves both to designate that filing division and to indicate the aisle or sales area in the store to which that filing division and its components and all of their coupon contents relate,
   2. the remainder of card 40, other than that portion comprising tab area 22, which comprises front surface 76;

b. envelope 62, having pocket area 26 for holding manufacturers' coupons for products displayed for sale on the corresponding aisle or sales area of that store to which this filing division relates; and c. the back surface 74 of the adjoining card divider 38.

On each filing division's tab area there also are placed indicia relating to one or more specific product category. For example, the representative filing division shown in FIG. 1 has specific product category listings 94 to 98 on tab area 22. These categories each relate to the aisle number or to the name of the sales area exhibited on the tab by virtue of the fact that each is a member of the class of those categories of products that are specifically displayed for sale on that aisle or in that sales area of that store which corresponds to that aisle number or to the name of the sales area on that same filing division's tab.

The back surface 74 of card divider 38 may have two display advertisements 102 and 104. Card divider 40 also has one display advertisement 100, which is partially hidden from the user's view by the coupon grouping 24 within pocket area 26 of envelope 62.

The preferred embodiment of envelope 62, as shown in FIG. 2, has walls 78 and 80 constructed of clear vinyl which enable advertisement 100, which envelope 62 is superimposed over on the front surface 76 of card 40, to be less than totally obstructed.

As shown in FIG. 1, envelope 62, positioned immediately in front of card 40 in booklet 12, is generally rectangular and oblong. It is engaged into binding 14 along its long sealed side 82. Envelope 62 has its opposite long side 84 open to receive coupons into its pocket area 26. The outboard side of envelope 62 is one of its short sides and is sealed and reinforced to limit coupons in pocket area 26 from sliding beyond its said outboard side 86, which aligns with the vertically stacked outboard edges of the planar stack of card divider and envelope components which form the outboard side of booklet 12. The inboard short side 88 of envelope 62 also is open.

As shown in FIG. 2, there is a flexible extension flap area 90 of the front wall 80 of envelope 62 and a corresponding flexible extension flap area 92 of the back wall 78 of envelope 62. These flexible flaps extend beyond the last inboard point where envelope 62 is engaged into binding 14. These cantilevered extensions are design to enable these walls to be better capable of being manually spread farther open. This facilitates the ease with which the user opens flexible walls 78 and 80 for fingering through and reviewing any coupons contained therein, as well as for either storing coupons into or retrieving them from pocket area 26 of envelope 62. After being released from being spread, the said clear vinyl walls and their flexible extension flaps elastically retract back into their original shape decreasing the volume of pocket area 26. This exerts a slight retaining force upon coupons in coupon grouping 24, and these vinyl walls 78 and 80 exert a slight electrostatic sheet retention force upon the outermost surfaces of any paper coupons within coupon grouping 24.

The purpose of constructing envelope 62 of clear vinyl walls is so that the outer surfaces of the coupons can be viewed through its transparent walls 78 and 80, such that the messages of those coupons, as well as advertisement 100's message, can be apprehended by the user. To retain these coupons, two adjacent sides 82 and 86 of envelope 62, as shown in FIG. 1, are sealed. To facilitate access, the other two adjacent sides 84 and 88 are open.

In all cases, those sides of envelope 62 that are open are the long side 84 opposite the long side that is affixed into binding 14 and the inboard short side 88. Envelope 62, and each of the others serving as receptacles for their respective filing divisions, is constructed of heat-sealed clear vinyl which is die-cut to produce the described shape and to be of the size that approximates the maximum size of coupons generally. These envelopes are positioned alternately in booklet 12, alternating from a right-side position, as depicted by envelope 62 in FIG. 1, FIG. 2, FIG. 5, and FIG. 9 to a left-side position, whereby the envelope shown therein is positioned as if rotated around a longitudinal axis that is perpendicular to that of the latitudinal axis of binding 14.

The reason for alternating the positioning of these envelopes is to avoid any uneven layering of coupons grouped within them. Were the envelopes not alternated as in this preferred manner, one half of device 10 may have a depth dimension significantly different from that of the other half of device 10 because all coupons would have been stored into envelopes on one half with no coupons being stored on the other half. Alternating the envelopes, right and left, eliminates this potential problem.

Display advertisements 102 and 104 on back surface 74 of card 38 and display advertisement 100, on front surface 76 of card 40 are each for a brand name product that is a member of the class of those brand name products that are displayed for sale on the numbered aisle or in the unnumbered sales area of the store that corresponds to the filing division card divider upon which that advertisement is placed. For example, in the representative filing division shown in FIG. 1, indicated by the number 20 on that filing division's tab area 22, each of advertisements 100, 102, and 104 are advertisements for brand name products that are members of the class of brand name products that are displayed for sale on the numbered aisle or in the unnumbered sales area of that store which corresponds to the filing division aisle number or sales area name 20 that those advertisements are located within in device 10.

The graphics of these advertisements, in addition to their advertising messages, also serve to direct the user to the location of either that specific product within that store, or to the location of any coupon for such a product within that filing division within device 10. The display advertisements in any filing division may be either for products specifically produced for that store or its chain, i.e., store brands, or for products produced for regional or national marketing, i.e., manufacturer's brands, or for some combination of the two. Furthermore, within any given filing division, more than one display advertisement may be placed by the same manufacturer, or two or more brand name product manufacturers may each place advertisements for their respective competitive brand name products, or advertisements may be placed for unrelated brand name products which simply happen to be located on the same aisle or in the same sales area of that store as of the time when information for the advertisements was compiled.

Figure 3:
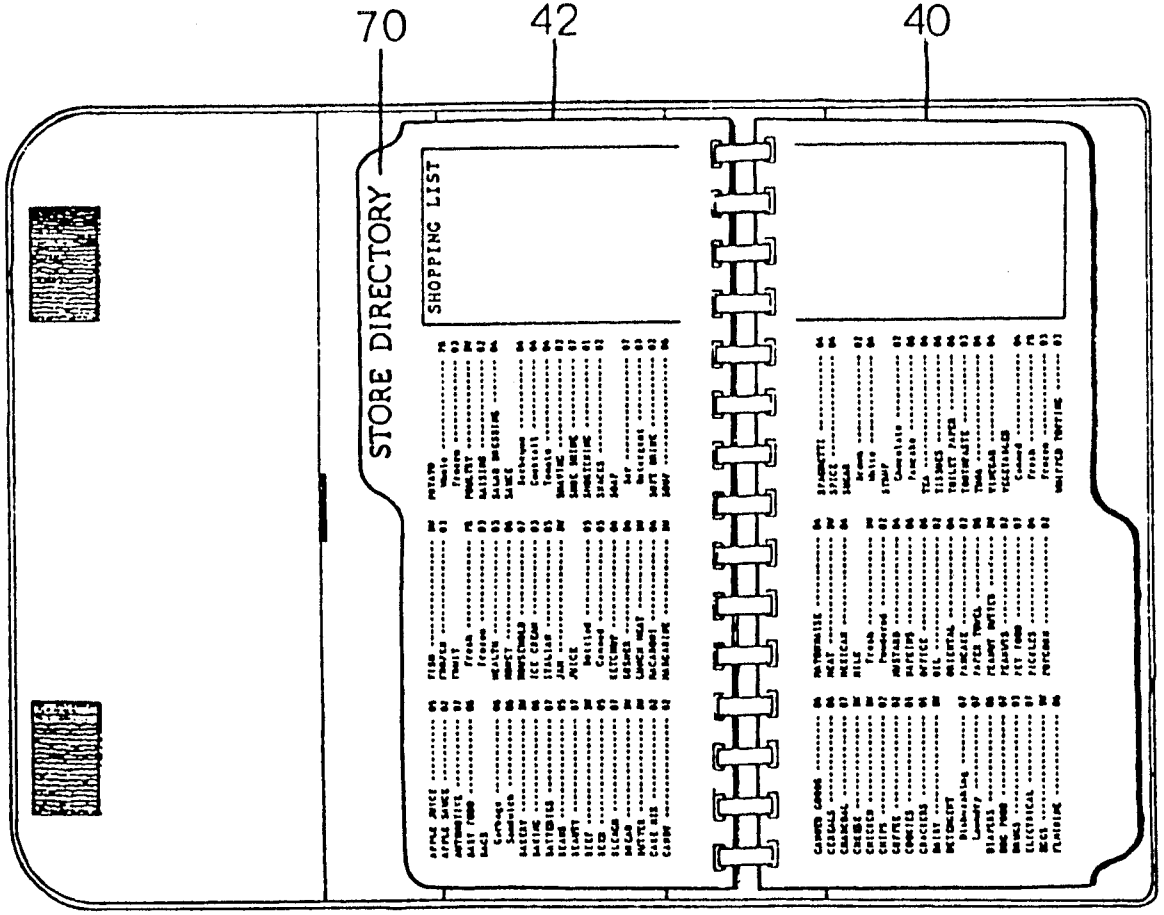
FIG. 3 is a plan view of a store directory section within the coupon-holding device exhibiting that particular store's item categories and the respective aisle location of each therein.

The method of filing by location used by device 10 provides the user with control over which filing divisions will be created, and into which filing division each newly acquired coupon will be stored. Thus, each filing decision is initiated by the user's having taken one or more of the following steps:

a. using one's own memory, i.e., from one's being familiar with and recalling a specific product's location within that store;

b. seeing the specific product category listings 94 to 98 on tab area 22 and/or the graphics of the filing division's display advertisements 100 to 104, and these, as a consequence, having refreshed the user's recollection with regard to either:
   1. the location within that store of that brand name product being advertised, or
   2. the location of a similar competitive product, or
   3. the location of an unrelated product remembered to be located on the same aisle or in sales area as the product category listed on the tab or the advertised brand named product; or c. in the absence of being able to form any such recollection, seeing the indicia on tab area 106, as depicted in FIG. 3, indicating the existence, location, and function of the store directory section within device 10, and turning to it, and consulting its alphabetical listing of product categories, placed on the front of card 42 and the back of card 40, each listing of which is made specific by virtue of its being within the class of product categories actually displayed for sale on that numbered aisle or in that named sales area which is set forth therein as that product category's location, from which the user deduces the filing location of any coupon, as well as determining where that specific product being sought is located within that store.

For example, within that said grocery store, the user of the device may be looking for steak sauce; and, not finding that listed on either the tabs or in the store directory section, may recognize that steak sauce is a condiment, and may find the product category "condiment" listed in the store directory section and may refer to the location listed therein and find the steak sauce at that store location. In the alternative, the user may refer to another specific product category which has a similar function, such as "mustard", and then may find "mustard" listed as being displayed for sale on an aisle or in a sale area of the store, and deduce that steak sauce is very likely to be shelved nearby the location of the "mustard", and may find it there.

During the step of filing away a newly acquired coupon for steak sauce, the user may determine the aisle upon which steak sauce is displayed for sale by using one or more of the steps just described, and then by filing it in the envelope related to the filing division corresponding to that aisle or sales area.

Conversely, if the user finds the steak sauce in the store and wants to find any coupon that may have been filed away in the device earlier, he or she looks under the filing division corresponding to that aisle or sales area where the steak sauce was located in the store.

For storing coupons, the card divider and envelope leaves of the device may be placed to lie flat, as shown in FIG. 1. The user may, for example, place device 10 on a table and open its leaves fully to as much as a 180 degree angle.

Figure 9:
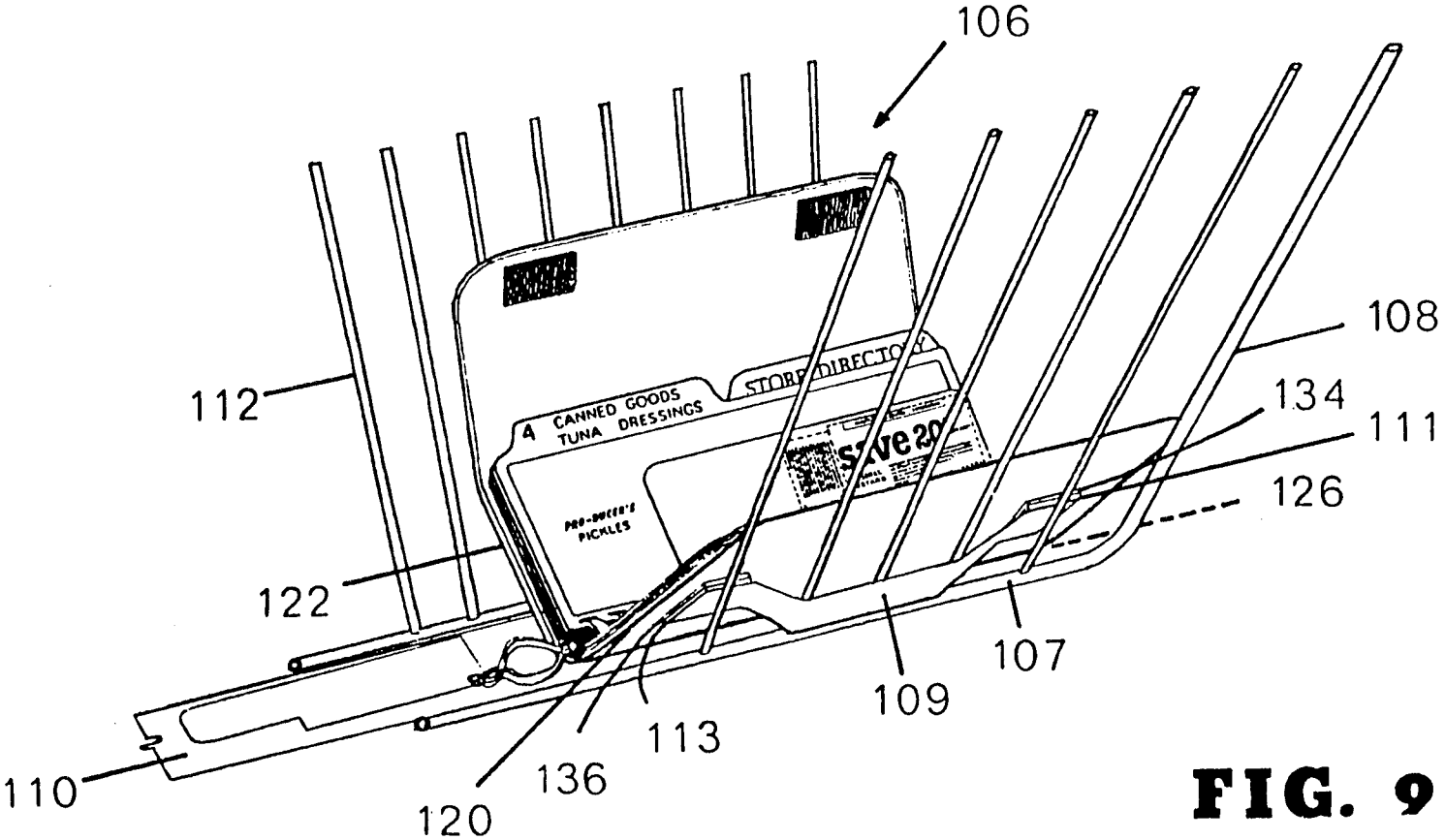
FIG. 9 is another perspective view of the device in a shopping cart showing its retension strap being used to help immobilize the device while it is being used in a rolling cart.

In retrieving coupons, while device 10 is positioned in front hopper 106 of a shopping cart, as shown in FIG. 5, there generally is insufficient width at the hopper's bottom wall 110 to allow device 10 to lie flat thereon. Consequently, as described in FIG. 6, device 10's cover 16 flexs at fold line 126; and, as shown in FIG. 9, device 10 may be positioned so that fold line 126 rests on the horizontal plane of bottom wall 110 in such a way that the angles formed by the cover's first panel 120 and its second panel 122 with bottom wall 110 are approximately the same—with the edges of those panels farthest from fold line 126 contacting and resting against the plane of front wall 108 and back wall 112 respectively. The purpose of this is to keep the leaves of device 10 from involuntarily rotating and closing as a result of vibration of the shopping cart during operation in instances where the said width of bottom wall 110 is severely insufficient. Device 10 may be retained in that position, as shown in FIG. 9, by the shopper attaching stability strap 109 to device 10 horizontally; and when not in use, strap 109 may be stowed in the currency pocket of the third, flap, panel 124 of cover 16, which is described later. Stability strap 109 has two fasteners, 111 and 113, attached to it. The user runs this strap horizontally around the vertical components of front wall 108 outside of hopper 106 and back inside again, as shown in FIG. 9, in such a way that its ends come through the voids in the wire or waffle-grille plastic rack of front wall 108, and fasteners 111 and 113 of strap 109 releasable attach to corresponding fasteners 134 and 136 which are on the exterior surface of first panel 114 of cover 16. Stability strap 109 is positioned in such a way that its lower horizontal edge 107 rests upon the horizontal component of front wall 108. This delimits first panel 120 from slumping down to lie upon bottom wall 110, as a result of vibration—a condition that may result in the latter leaves of booklet 12, which are positioned adjacent to second panel 122, being involuntarily rotated and closed. Having strap 109 in such an adjustable position helps the shopper immobilize this longitudinal sliding of device 10 within hopper 106 while the cart is in operation and while the shopper is turning the card and envelope leaves of device 10.

The preferred embodiment's tabbed card dividers may be made of coated paperboard, tag or index cardstock, or the like. The cards are adapted and sized to achieve the objectives described herein and those generally associated with such printer's materials and their practical usage. These cards are each sized to be somewhat longer and wider than the maximum size of coupons generally, so as to have sufficient card area available for the display advertisements. In that way, for example, coupon grouping 24 held within pocket area 26 of envelope 62, as shown in FIG. 2, would not totally be superimposed over display advertisement 100 on the front surface 76 of card divider 40, so that the display advertisment's message and its function in directing the user would not be compromised altogether.

These visually apprehendable advertisements 94 to 104 are intended to stimulate the user of the device to purchase the advertised brand name products. Their messages reach the shopper at or very near the point-of-purchase. That is, the user is visually shown the advertisement on the aisle or in the sales area where products of that category are located and displayed for purchase. Upon turning the tabs of the filing divisions of device 10 and apprehending the graphics of such a display advertisement within that filing division, the advertisement may either stimulate the user to purchase that brand name product or it may direct the user to file a newly-acquired coupon for such a product within that filing division. Hence, the advertisements serve the aforementioned dual purpose of acting as a directory. Furthermore, while shopping, these display advertisements' graphics provide an easier way for the user to keep device 10 turned to the applicable filing division that corresponds to that aisle or sales area upon which the shopping is then being conducted than to have to read the relatively small aisle numbers and names or the representative product categories placed on the tabs and compare these tab indicia to either that on the signage for that aisle or sale area or to the items on its shelves.

Using these advertisement graphics as cues, the user can be assured, in the first instance, that each coupon is correctly filed away; and, therefore, that it will be available during the second step of retrieval on the aisle or in the sales area where it is needed when it is needed, i.e., when the shopper is there looking to bring together the product and any coupon for that product so that a comparison can be made with other competing products and a buying decision can be made. The coupons will be available among grouping 24 when the shopper gets to the point in that store corresponding, for example, to the number 20 under whose filing division the coupon was filed.

Figure 7:
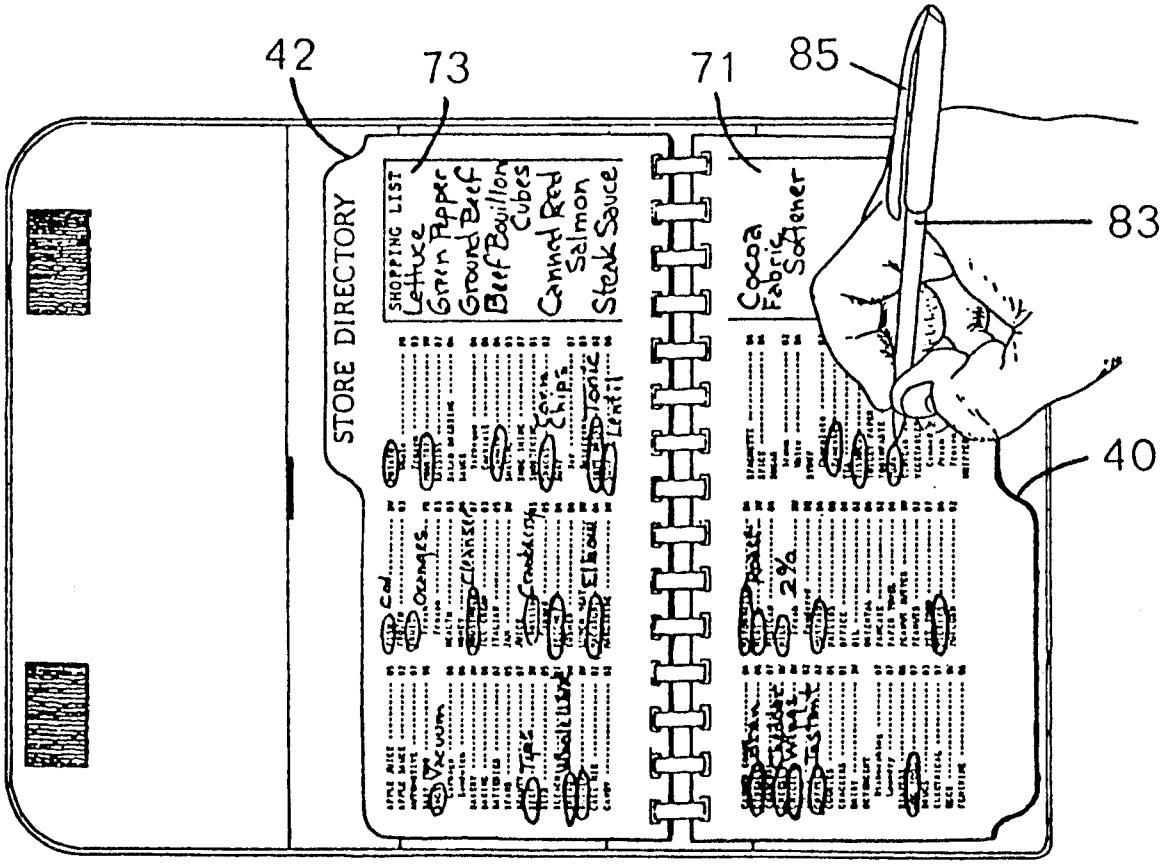
FIG. 7 is a plan view of the store directory shown in FIG. 3, with the addition of a transparent film overlay above its printed surface and showing a user compiling his shopping list by means of an erasable writing instrument.

FIG. 7 depicts clear plastic laminate 71 over the store directory section on the back surface of card divider 40 and clear plastic laminate 73 over the store directory portion on the front surface of card divider 42. This shopping list feature over the store directory serves as an aid in the form of a checklist to help remind the user of his or her need to purchase certain items from among the various product categories. It also may be reviewed, and this helps to assure the user that there is minimal likelihood that he or she has inadvertently left some item off of that shopping list. Users of this device are encouraged to keep the device in a convenient place at home and make occasional entries onto the said laminated portions of the shopping list using the marking instrument that is stowed in barrel area 87 of binding 14. These notations may be by such means as underlining, circling, or writing in additional items, as shown in FIG. 7.

Figure 8:
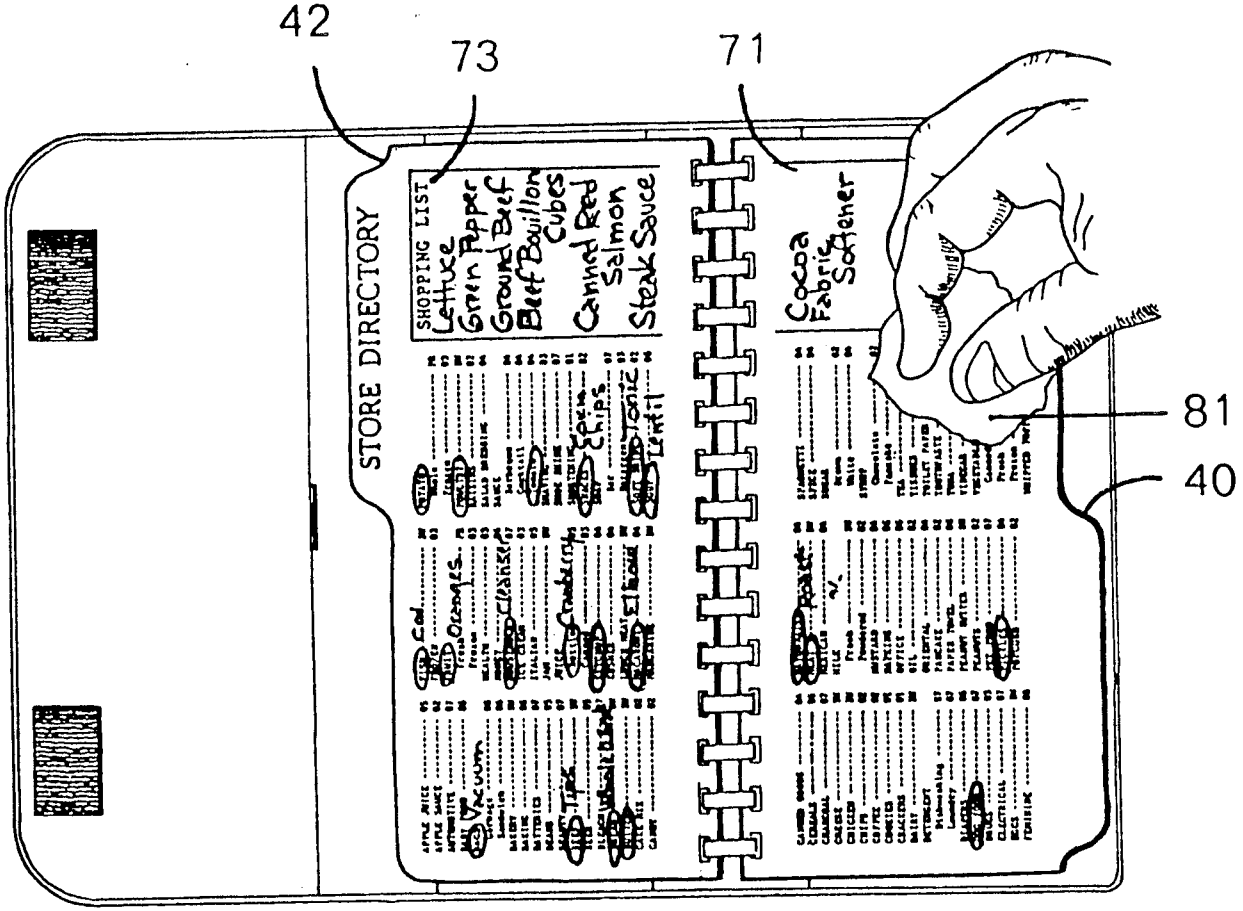
FIG. 8 is a plan view of the shopping list overlay above the store directory shown in FIG. 7 showing the user erasing the list, after it has been used while shopping, with a few swipes of a dampened paper towel.

FIG. 8 depicts the shopping list of FIG. 7 being erased by means of a dampened paper towel 81. This erasure, when completed, leaves laminate surfaces 71 and 73 clean so that the user can start another shopping list thereon at any future time. Waterbase marking instrument 83 has a clip 85 which enables it to be stored when not in use in barrel area 87 of binding 14. Clip 85 goes over the side of and around cover 16; and the pincer tension created by clip 85 holds instrument 83 in place, as is shown in FIG. 4.

The store directory section of device 10 shown in FIG. 3 and its shopping list overlay as shown in FIG. 7 both serve the user as a source of information about the location of products in that store to which it is keyed; and they also enable that user to deduce which aisles and sales areas of that store, if any, may safely be skipped altogether during that shopping trip. This aspect is especially important to shoppers in a hurry and those shoppers with small children along who may wish, for example, to avoid the candy aisle or the cereal aisle, if doing so were at all possible.

Figure 6:
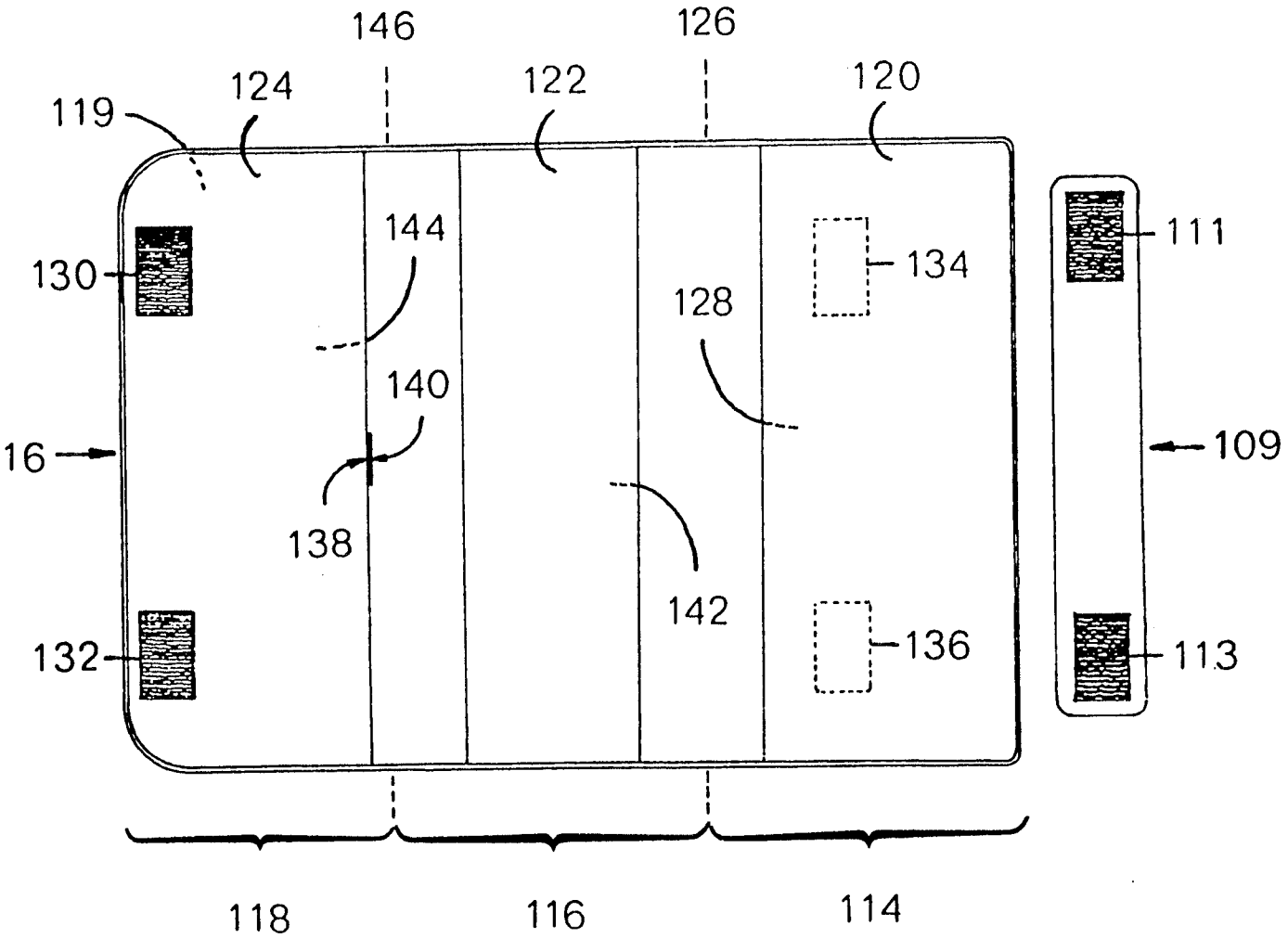
FIG. 6 is a plan view of the cover of the device and the associated retension strap used with the cover which helps hold the device more securely in position while it is placed within a shopping cart.

As shown in FIG. 6, device 10 has a three-panel cover 16, the preferred embodiment of which wraps around and seals device 10 to protect and hold its components and its coupon contents. Cover 16 has a first panel 114, a second panel 116, and a third panel 118 which acts as a flap, so that, when cover 16 is over-and-over folded, third panel 118 folds over first panel 114 and seals thereto. Cover 16 is constructed of a heat-sealed opaque vinyl exterior layer 119 with clear vinyl interior layer 120 forming slip pocket 128, interior clear vinyl strap 122 forming slip strap area 142, and an opaque vinyl interior layer 124 forming sealable pocket 144. All three of the interior layers are heat-sealed to exterior layer 119 to form cover assembly 16.

First panel 114 has a clear vinyl interior layer 120 which is generally rectangular and oblong, and is coterminus with and heat-sealed to first panel 114 of the opaque exterior layer 119 of cover 16 on both of its short sides and on one of its long sides. Interior layer 120 is open on its other long fourth side, thus creating slip pocket 128 that parallels fold line 126, which is the center line of the fold between first panel 114 and second panel 116.

Similarly, second panel 116 has a clear vinyl strap 122 that is generally rectangular and oblong and on each of its short sides is coterminus with and heat-sealed to portions of the perimeter of second panel 116 of the opaque exterior layer 119 of cover 16, but is open on each of its two long sides, one of which is parallel to fold line 126 and the other of which is parallel to fold line 146, which is the center line of the fold between second panel 116 and third panel 118.

The purpose of cover 16 having pocket area 128 in first panel 114 is for pocket area 128 to receive front slip pocket card 30. Similarly, the purpose of cover 16 having strap 122 in second panel 116 is to create slip strap area 142 to receive back slip strap card 52 between strap 122 and the interior surface of exterior layer 119 of cover 16, so as to retain cover 16 onto bound booklet 12 so that cover 16 may be manually enfolded in order to protect device 10's card and envelope leave components and its coupon contents.

Any fastener which will accomplish this purpose in the art may be used. The type of fastener used in the preferred embodiment, depicted in FIG. 1, and FIGS. 3 through 9, is comprised of a pair of self adhesive strips comprised of plastic filaments, one strip of which, the "male" strip, has stiff filaments comprised of small hooks which, under magnification, appear to be similar in shape to crochet hooks. These mesh with and hold onto the material of the other "female" strip which is of a texture similar to that of velvet fabric. These pairs of fastener strips releasably seal together when they are manually placed into contact with one another, thus temporarily retaining the said panels of cover 16 to each other, and thus retaining the components of and the coupon contents of device 10 therein. In the preferred embodiment, when the third panel 118 of cover 16 is folded, by parallel over-and-over folding, to wrap around the folded first panel 114, "female" fasteners 130 and 132 on the interior surface of the opaque inner layer 124 of third panel 118 contact "male" fasteners 134 and 136 on the exterior surface of the exterior opaque layer 119 of the first panel 114 of cover 16. In addition to securing cover 16 closed, fasteners 134 and 136 do double duty. When device 10 is opened and placed in hopper 106, as shown in FIG. 9, they may be affixed to "female" fasteners 111 and 113 on retension strap 109 to help immobilize device 10 within hopper 106. In the unlikely event of an attempted theft of the device from the shopping cart, the shopper may be alerted by the distinctive sound of these fasteners being separated, and may respond to it and investigate. The shopper's pocketbook may have retension strap 109 passed through its shoulder strap before being sealed, to obtain similar security. As depicted in FIG. 6, third panel 118 has an interior opaque vinyl layer 124 which is generally rectangular and oblong, and on both of its short sides and on one of its long sides is coterminus with and heat-sealed to portions of the perimeter of third panel 118 of the opaque exterior layer 119 of cover 16 and is open on its other long fourth side, thus creating sealable pocket 144, which parallels fold line 146.

For the purpose of helping the user to retain within pocket area 144 such articles as retension strap 109 and currency enough to avoid having to carry one's pocketbook into the store, pocket area 144 is rendered sealable by means of "female" fastener 138 being mounted on the exterior surface of interior layer 124. Fastener 138 is placed to align with and similarly affix to said "male" fastener 140 on the interior face of exterior layer 119 of cover 16, as shown in FIG. 6.

Cover 16, as shown in FIG. 4, closes first to render the overall size of device 10 more compact for ease in storing it at home, as well as while the user is transporting it to and from the store. Secondly, cover 16 is sealable so as to protect the coupon contents of device 10 against spillage, if device 10 were to be dropped.

When cover 16 is in its closed position, as shown in FIG. 4, the exterior surface of the third, flap, panel 118, forms the top of device 10; and it may have advertising exhibited upon it, which, for example, displays the name of, any logo for, the address of, and the telephone number of the store to whose layout the contents of device 10 have been keyed.

Device 10 has a special receptacle 18 tethered to it, which for example, may manually be user-placed without and along side of device 10, while shopping, as shown in FIG. 5, for the purpose of temporarily retaining coupon shopping related articles therein, including coupons for products that the shopper has placed in the shopping cart and which the shopper is in the process of purchasing. The preferred embodiment of envelope 18, is constructed of a back wall 148 of clear vinyl and a front wall 150 of clear vinyl. These two walls are heat-sealed on two adjacent sides, one long sealed side 152 and one short sealed side 154, and is left unsealed and open on the opposite two sides, one long open side 156 and one short open side 158, to form pocket area 160 in envelope 18. Envelope 18 is tethered to device 10 by means of a connector, such as flexible band 162, of sufficient length to allow it to be manually moved freely throughout all three axes; and to allow the user to remove tethered purchases envelope 18 out from among the card and envelope leaves of bound booklet 12 of device 10 and place and keep envelope 18 outside of device 10 while shopping, so that envelope 18 may be easily found by the user who thus avoids having to flip the leaves of booklet 12 looking for it, so that the user may store coupons within pocket area 160 of tethered envelope 18 for purchases in progress. These coupons can easily be retrieved for presentation to the cashier for credit at the checkout counter. After this, envelope 18 may be stored back within and among the bound card divider and envelope leaves of booklet 12 in a manner similar to that of a bookmark before cover 16 is folded closed and sealed, as shown in FIG. 4.

Custom editions of device 10 may be custom published for a particular store indexed to its store layout and offerred to its customers as a promotional vehicle that encourages them to organize their coupons around that store's layout and patronize that store on a more consistent basis.

Cost-cutting measures which frequently motivate customers to go from one store to another. Since device 10 generally works best at the store to whose layout its contents are indexed, a customized publication of device 10 may be useful in encouraging a store's customers to sort their coupons according to aisle divisions that mirror its layout. This promotion may turn cost-conscious shoppers of questionable loyalty into loyal repeat customers who accomplish noteworthy savings.

What is claimed as our invention is:

1. A method of organizing coupons by means of their being filed in a way which relates the aisle location of a given coupon's product within a particular store with a filing division indexed to that aisle location for the purpose of enabling one later to retrieve that coupon for consideration while shopping on that aisle, comprising the steps of:

indexing a plurality of filing dividers so that each relates to one of the various aisles or sales areas of the said store by means of placing number or letter indicia on the tab of each divider which identifies that aisle;

printing a store directory which exhibits names of item categories sold within that store;

placing, in relationship to the said names in the store directory, the respective aisle location of each item catagory;

inserting the said store directory and aisle-related filing dividers into a container to form indexed aisle divisions thereof, arranged seriatim according to a typical pattern of the flow of shopper traffic circulating throughout all of the store layout's aisles and sales areas;

determining where to file a given coupon from one's noting the name of its product from the coupon's face, then referring to the store directory to determine the aisle where items of that product's category are located within that store;

filing each coupon by aisle by means of placing it into the aisle-related filing division which is indexed to the aisle whereon the coupon's product is located within that store;

shopping a particular aisle of the said store, and locating various competitive products thereon which are within the category of an item which one is considering for purchase;

refering to the aisle division within the said coupon holder that relates to the aisle whereon the shopping is then being conducted, reviewing its coupon contents, and retrieving therefrom all coupons previously filed therein which have been issued for various products within the category of the said item being considered for purchase; and matching each of those coupons with their respective products for the purpose of determining both coupon applicability and for calculating the net price, after coupon credit, of each product for use in making a purchasing decision.

2. A portable coupon organizing device, comprising in combination:

a plurality of filing divisions, each indexed by means of an indicator being placed on its tab comprised of one or more numbers or letters which are the same numbers or letters as those designating an actual aisle within a particular store, or the same letters as an abbreviation of a sales area therein;

a store directory for the said store, positioned within the device, exhibiting the names of categories of items that are sold within that store together with the aisle location of each being placed in relation to the said item names respectively;

a means for the user to employ to determine which filing division is the applicable one into which to file any given coupon;

said means being for the user to refer to the said store directory, to take note of the category of item listed within that store directory, which relates to the product for which the coupon has been issued, to determine the number or letter of that item's aisle location, or the name of its sales area location, and to file that coupon in the said applicable filing division which relates to that aisle or sales area;

indicia placed on the tab of an aisle division exhibiting the names of categories of items that actually are displayed for sale on the aisle to which that particular filing division relates;

a means for locating coupons, while shopping, for any given product found in that store; and said means being for the user to refer to the filing division that relates to the aisle or sales area upon which that product is found, to sort through coupons that are filed thereunder, to select out all coupons that are for products that are within the category of the item that is being contemplated for purchase, and to match each of those coupons with their respective products for the purpose of determining both the coupon's applicability and for calculating the net price, after coupon credit, of each product for use in making a purchasing decision.

3. The device of claim 2 wherein a transparent overlay is placed over the said store directory permitting the user to compile an erasable shopping list on the outer surface of the said transparent overlay and use the same as a reminder while shopping and as a means of locating which aisles must be shopped in order to obtain all of the items on the shopping list by means of:

the names of the item categories sold within that particular store being printed on the store directory together with the aisle location of each respectively being visible through the said shopping list's transparent overlay;

a means for the user to employ to compile a shopping list on the outer surface of the said overlay;

said means being for the user to refer to the said names of categories of items visible below and, using an erasable writing intrument, denoting an item desired for purchase and indicating any other descriptive information regarding that item, such as its brand name, product feature, flavor, quantity, size, or color;

a means for using the said compiled shopping list while shopping;

said means being for the user to refer to the items and their descriptions denoted on the said shopping list such that these notes may be used as reminders of what has earlier been determined to be needed at that store; and said means additionally being for the user to refer to the said respective aisle location of each item denoted on the shopping list and determining therefrom which aisles of that store must be shopped in order to obtain all of the items noted on the shopping list and which aisles may be skipped.

4. The device of claim 2 wherein display advertisements are placed upon the surfaces of the dividers to convey intellectual impressions to the user by means of:

point-of-purchase display advertisements on the filing dividers for products that actually are displayed for sale on the aisle to which that particular filing division relates; and the said point-of-purchase advertisements additionally perform the dual-purpose of providing the user with generalized intellectual impressions in the nature of graphic cues that help to associate an aisle division with the types of products exhibited thereon so that the user knows that the leaves of the device are opened to the division that he or she needs it to be opened to in order to correctly file away and retrieve coupons therefrom and may thus avoid having to read the smaller print of the said tab indicia.

5. The device of claim 2 wherein a pocketed envelope is interspersed between each tabbed filing divider to retain that aisle division's coupons during rotation of these divider and envelope leaf components, which is accomplished by means of their being multiple ring bound to form a booklet-like device, the rotational functioning of which enables the user to keep all filing division compartments closed unless he or she opens the device to a particular aisle division, whereby the divider and envelope leaves of that one division alone rotate into a flat-opening position to enable the user to have full acess to its envelope and to the coupons therein.

6. The device of claim 5 wherein a separate pocketed envelope is attached to the said coupon-holding device by means of a tether connector of sufficient length to allow this special receptacle either to be placed by the shopper within the device, in the manner of a bookmark, or to be placed outside of the coupon-holding device, while shopping, for use as a temporary receptacle for coupons that are for products that have been selected from the shelves, until such time as these accumulated coupons are retrieved therefrom for presentation to the cashier for credit.

7. The device of claim 5 wherein a three-paneled cover is releasably attached to one or more of the outer leaves of the said bound-booklet by slip pocket means and, when the said cover's third panel is folded over upon the surface of its first panel, two hook and loop type fasteners upon each of these panels fasten these two panels together securely enwrapping the device's components and retaining its coupon contents therein, which cover has the following additional features:

an advertisement placed on the top exterior surface of the said cover exhibiting any logo for, the name of, the address of, and the telephone number for, the store to whose aisle and sales area layout the said device is indexed; and a stability strap, having hook and loop fasteners positioned thereon, for use by the shopper in retaining the said covered device in its opened position resting upon the bottom of the front hopper of a shopping cart by means of placement of the said strap in a generally horizontal position on the exterior face of the front wall of the hopper of the shopping cart, and by threading each end of the said strap through the voids in the said wall of the cart in such a manner as to releasably attach the fastener near the end of each of the strap's two ends to one of the two cooperating fasteners on the cover's first panel for the purpose of securing the said covered device in the said position.

* * * * *